United States Patent [19]

Lane

[11] 4,005,842

[45] Feb. 1, 1977

[54] TWIST-OFF, BREAK-AWAY OPENING COVER

[75] Inventor: William B. Lane, West Covina, Calif.

[73] Assignee: Deccofelt Corporation, Glendora, Calif.

[22] Filed: July 31, 1975

[21] Appl. No.: 600,569

[52] U.S. Cl. ..... 248/200; 248/205 A

[51] Int. Cl.[2] ..... A47B 96/06

[58] Field of Search ..... 248/200, 205 A, DIG. 6, 248/DIG. 9; 174/64, 65 R; 220/265, 266, 277; D6/85, 99, 114; 85/61, 53, 55

[56] References Cited

UNITED STATES PATENTS

| | | | |
|---|---|---|---|
| 1,970,071 | 8/1934 | Bengtsson | 85/61 |
| 2,000,851 | 5/1935 | Knell | 220/266 |
| 2,714,519 | 8/1955 | Hill | 220/265 |
| 2,764,817 | 10/1956 | Schwartz | 248/205 A |
| 3,174,383 | 3/1965 | Heil | 85/61 |
| 3,672,615 | 6/1972 | Fiorentino | 248/205 A |
| 3,728,470 | 4/1973 | Maier | 174/65 R |
| 3,807,457 | 4/1974 | Logsdon | 220/260 |
| 3,873,758 | 3/1975 | Van Gessel et al. | 174/65 R |
| 3,873,759 | 3/1975 | Schindler et al. | 174/65 R |

*Primary Examiner*—Robert A. Hafer
*Attorney, Agent, or Firm*—Boniard I. Brown

[57] ABSTRACT

A mounting base for a surface mounted fixture having a fastener receiving hole through the base concealed by a removable cover or cap whereby the base may be adhesively bonded to a mounting surface without removing the cap and thereby exposing the hole or, alternatively, the cap may be removed for attachment of the base to the mounting surface by a fastener inserted through the base hole. The cap may simulate the head of a threaded fastener, such as a screw, to provide the mounting base, even when adhesively mounted, with the appearance of being attached by a fastener and to permit removal of the cap with a twisting action applied by a fastener setting and removal tool such as a screw driver.

4 Claims, 7 Drawing Figures

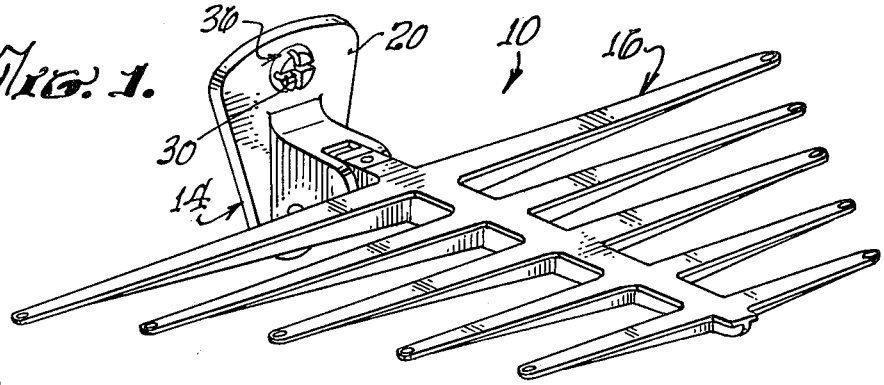
Fig. 1.
Fig. 2.
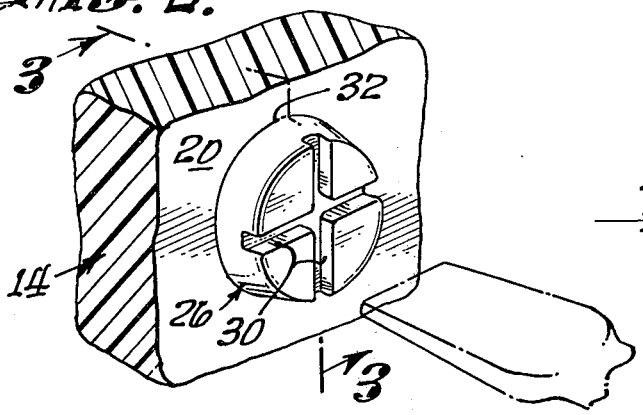
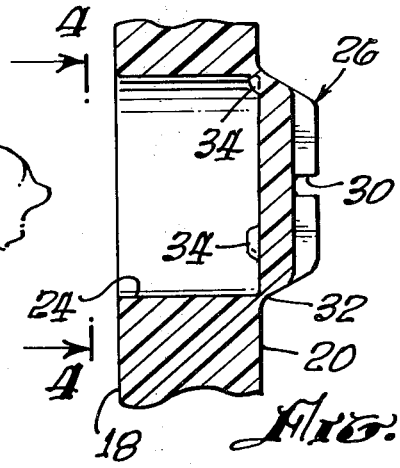
Fig. 3.
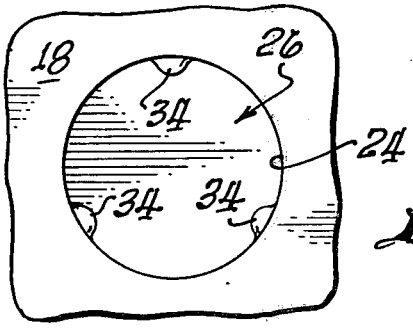
Fig. 4.
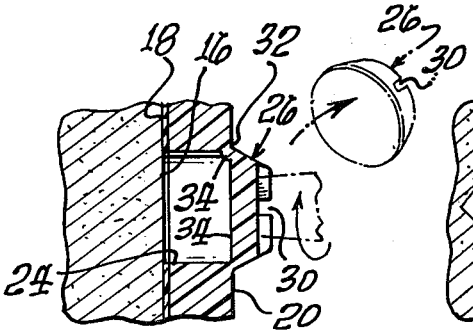
Fig. 5.
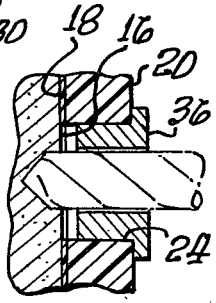
Fig. 6.
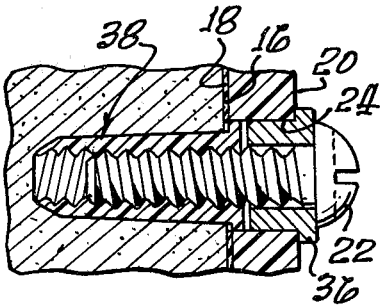
Fig. 7.

TWIST-OFF, BREAK-AWAY OPENING COVER

BACKGROUND OF THE INVENTION

1. Field of the Invention:

This invention relates generally to surface mounted fixtures and more particularly to a novel mounting base for such fixtures having a concealed fastener receiving hole which permits adhesive bonding of the base to a mounting surface without exposing the hole or attachment of the base to the surface by a fastener inserted through the hole.

2. Discussion of the Prior Art:

As will appear from the ensuing description, the mounting base improvements of this invention are particularly suited for use on wall mounted household fixtures, such as mounting brackets, towel racks, drying racks and the like. For this reason, the invention will be described in the context of this particular use. However, it will become readily evident as the description proceeds that the invention may be used to advantage in a variety of other surface mounted structures having a mounting base or base-like portion to be attached to a mounting surface.

A variety of household fixtures, such as brackets of various kinds, towel racks, drying racks and the like are designed for attachment to a wall or other mounting surface either or both by screws and adhesive bonding. To this end, the fixture includes at least one mounting portion referred to in this disclosure as a mounting base, for seating against the mounting surface. This mounting base has holes through which screws may be inserted into the mounting surface to attach the base to the surface. Alternatively, the base may be adhesively bonded to the mounting surface.

The existing fixture mounting bases of this kind have one disadvantage which this invention overcomes. This disadvantage resides in the fact that if the bases are adhesively mounted, their screw holes are exposed and present an unsightly appearance unless they are suitably covered or filled in, which is difficult to do.

SUMMARY OF THE INVENTION

This invention provides an improved mounting base for a surface mounted fixture which may be either attached to a mounting surface by screws or other fasteners or by adhesively bonding the base to the surface and which presents no unsightly exposed screw holes when adhesively bonded. To this end, each fastener hole in the mounting base is covered and concealed by a removable cover or cap, which is left on the base when the latter is adhesively bonded to a mounting surface. If the base is to be fastened to the mounting surface by screws or the like, the hole caps are removed to permit insertion of the mounting screws through the holes into the surface.

According to a novel feature of the invention, the removal hole caps may be shaped to simulate the heads of screws or other fasteners so that even when the mounting base is adhesively bonded to a mounting surface, it presents the appearance of being attached to the surface by fasteners. In the particular mounting base described, for example, the hole caps project beyond the front surface of the plate and are slotted to resemble screw heads.

According to another feature of the invention, each cap, when shaped to simulate a fastener head, is designed for removal from the mounting base with a twisting action exerted by the same type of fastener setting and removing tool which is normally used on the fasteners which the cap resembles. Thus, each cap of the described mounting base is designed for removal by a screw driver. To this end, the cap is attached to the mounting base by a thin frangible web which extends between the perimeter of the cap and the front edge of the hole covered by the cap in such a way that the web is easily fractured to remove the cap by inserting a screwdriver blade in the cap slot and twisting the blade. This described mounting base, cap, and web configuration is injection molded in one piece from a suitable plastic. An additional feature of this described embodiment resides in the provision of shoulder means about the wall of the hole covered by the cap for engagement with the inner side of the cap to prevent the cap from being forced into the hole as it is being twisted for removal from the mounting base.

BRIEF DESCRIPTION OF THE DRAWINGS

FIG. 1 is a view of a surface mounted fixture embodying an improved mounting base according to the invention;

FIG. 2 is a fragmentary perspective view of the improved fixture mounting base;

FIG. 3 is a section taken on line 3—3 in FIG. 2;

FIG. 4 is a view looking in the direction of the arrows 4—4 in FIG. 3;

FIG. 5 illustrates the manner of removing a hole cap for attachment of the mounting base to a mounting surface by a screw; and FIGS. 6 and 7 illustrate the manner of attaching the base to the mounting surface with a screw.

DESCRIPTION OF THE PREFERRED EMBODIMENT

Turning first to FIG. 1 of the drawings, there is illustrated a surface mounted fixture 10 embodying this invention. The particular fixture illustrated is a drying rack like that shown in the earlier mentioned design patent. This rack includes a mounting base 14 to be attached to a mounting surface 16, such as a wall, and article supporting means 16 secured to the base. The present invention is concerned only with the mounting base 14 and the manner of its attachment to the mounting surface 16. In this regard, it is again emphasized that while the invention is described in connection with a household drying rack, the novel improvement features of the invention are susceptible of utilization in a wide variety of other surface mounted fixtures, brackets, and the like.

Referring now to FIGS. 2–7, mounting base 14 has a rear side 18 for seating against the surface 16 on which the plate is to be mounted and an opposite, normally exposed front side 20. The invention contemplates attachment of the mounting base 14 to the mounting surface 16 in either of two ways. One of these ways involves adhesively bonding the rear side 18 of the base to the mounting surface. The other way involves mechanically securing the base to the mounting surface by means of fasteners, such as screws 22.

To this latter end, the mounting base 14 is provided with at least one hole 24 for receiving a fastener 22. As noted earlier, one disadvantage of the existing fixture mounting arrangements of this kind resides in the fact that if the adhesive bonding method is utilized, the fastener holes in the fixture mounting base are exposed and present an unsightly appearance. According to this invention, the latter deficiency of the existing mounting arrangements is avoided by concealing each base hole 24 with a removable cover or cap 26. If the mounting base is to be installed by the adhesive bonding method, the cap 26 is left in place. On the other hand, if the fastener attaching method is used, the cap is removed to permit insertion of a fastener 22 through the hole 24 into the mounting surface 16, in the manner shown in FIG. 7 of the drawings.

In the particular mounting base 12 illustrated, the hole cap 26 projects beyond the front side of the base and is shaped to simulate the head of a fastener, such that even though the base is adhesively mounted, it presents the appearance of being mounted by fasteners. The cap shown simulates a screw head and, to this end, is slotted at 30 to simulate screw driver slots. Other fastener head configurations may be simulated, of course.

Cap 26 is removably or releasibly attached to the mounting base 12 by means 32 which, in this instance comprises a thin frangible web integrally joining the perimeter of the cap to the front edge of the hole 24 covered by the cap. This web extends the full circumference of the cap and hole and is formed integrally with the cap and base by injection molding the entire base, cap and web structure in one piece from plastic or other suitable material.

A unique feature of the illustrated mounting base configuration resides in the fact that the cap 26 is designed to be removed by the same type of tool which is normally used with the fastener which the cap simulates. The illustrated cap, for example, is designed to be removed by inserting the blade of a screw driver in the cap slot 30 and twisting the blade with sufficient torque to fracture the frangible web 32, as shown in FIG. 5. To this end, the web is sized to be fractured by a force or torque less than that which would cause stripping of the cap slot 30 or other damage, when thus removing the cap, of course, an inward force or push is exerted on the screw driver to retain its blade in the slot. In order to avoid pushing of the cap into the mounting base hole 24 during this removal of the cap, shoulder means 34 are provided about the wall of the hole to support the cap against movement into the hole.

It will now be understood that the illustrated mounting base may be adhesively bonded to the mounting surface 16, in which case the cap 26 is left intact on the base to conceal the fastener hole 24 and in addition simulate a mounting fastener for the base. Alternatively, the cap may be removed to permit attachment of the base to the mounting surface by a screw 22, in the manner shown in FIGS. 6 and 7. In this case, installation of the mounting screw is accomplished by first inserting a bushing 36 into the hole 24 and drilling through the busing into the mounting surface 16. An expansion plug 38 is then inserted into the drilled hole in the mounting surface, after which the screw 22 is inserted through the busing and threaded in the plug. A slight clearance is provided between the busing and plug to assure seating of the base firmly against the mounting surface when the screw is tightened.

The inventor claims:

1. A fixture for attachment to a mounting surface comprising:

a mounting base having a rear side for seating against said mounting surface, an opposite, normally exposed front side, and a hole to receive a fastener for securing the base to said surface;

a removable cap integrally formed at the front side of said base concealing said hole, said cap being shaped to simulate the head of a screw fastener having at least one closed recess formed therein to receive a screw driver;

said cap projects beyond the front side of said mounting base to simulate a fastener head seating against said front side; and means releasably securing said cap to said base comprising an adhesive bonding material disposed on said rear side of said mounting base, whereby said base may be adhesively bonded to said mounting surface without exposing said hole by leaving said cap on the base, or the cap may be removed to permit attachment of the base to said mounting surface by insertion of a fastener through said hole.

2. A fixture according to claim 1 wherein:

said cap securing means comprises a frangible web integrally joining said cap and base.

3. A fixture according to claim 2 wherein:

said cap has a slightly smaller diameter said hole and said web extends between said cap and the front edge of said hole about the full circumference of said cap.

4. A mounting bracket according to claim 3 wherein:

said base includes shoulder means about the wall of said hole engaging the rear side of said cap to prevent movement of the cap into the hole.

* * * * *